United States Patent [19]

Hanna

[11] 4,240,757

[45] Dec. 23, 1980

[54] FANFOLD REPLACEMENT RIBBON PACKAGE

[75] Inventor: Samuel Y. Hanna, Nashua, N.H.

[73] Assignee: Centronics Data Computer Corp., Hudson, N.H.

[21] Appl. No.: 972,800

[22] Filed: Dec. 26, 1978

[51] Int. Cl.[3] ..... B41J 33/10

[52] U.S. Cl. ..... 400/196.1; 400/207; 206/606; 206/815

[58] Field of Search ..... 400/194, 195, 196, 196.1, 400/207, 208, 208.1; 206/39.5, 83.5, 387, 388, 442, 460, 497, 605, 606, 613, 813, 815

[56] References Cited

U.S. PATENT DOCUMENTS

| | | | |
|---|---|---|---|
| 1,895,758 | 1/1933 | Goldsmith | 206/388 |
| 2,000,763 | 5/1935 | Lane | 206/813 X |
| 2,118,849 | 5/1938 | Lindsey | 206/606 X |
| 2,873,014 | 2/1959 | Lambert | 400/208.1 |
| 2,999,578 | 9/1961 | Holden | 400/207 |
| 3,074,545 | 1/1963 | Lasher | 400/208 |
| 3,355,010 | 11/1967 | Harrison | 206/497 |
| 3,481,445 | 12/1969 | Engle et al. | 400/208 |
| 3,758,012 | 9/1973 | Bonner et al. | 400/196 X |
| 3,987,901 | 10/1976 | Dullinger | 206/813 X |
| 4,018,643 | 4/1977 | Levine | 206/460 X |
| 4,113,750 | 9/1978 | Isobe | 400/196.1 X |

FOREIGN PATENT DOCUMENTS 50-144518 11/1975 Japan ..... 400/196.1

*Primary Examiner*—Ernest T. Wright, Jr.
*Attorney, Agent, or Firm*—Weinstein & Sutton

[57] ABSTRACT

A replacement ribbon package for ribbon cartridge assemblies. The package comprises a Mobius Loop ribbon arranged in full fanfold fashion within a channel-shaped ribbon holder. A semirigid stripper sheet positioned between the ribbon and the base of the channel-shaped member permits the ribbon to be simply and readily stripped from the channel-shaped member once the package is inserted into the ribbon cartridge housing. A tearaway wrapper, which encircles the channel-shaped member and the ribbon serves to loosely hold the ribbon fanfold portion to prevent any creasing. The package is designed to be placed into the ribbon cartridge housing to simplify the installation operation and eliminate handling of the ribbon portion inserted into the ribbon cartridge housing.

The package may be boxed or inserted within a plastic tray having a lid heat sealed to the tray flange.

Instructions may be printed upon the enclosure package, the tear strip, or upon a separate insertion.

19 Claims, 9 Drawing Figures

FANFOLD REPLACEMENT RIBBON PACKAGE

BACKGROUND OF THE INVENTION

Inked ribbons are typically employed in impact printers and are adapted to be impacted by the print member against the printing medium, which is typically a paper web, to transfer ink to the printing medium in the form of the print member inpacting the ribbon against the printing medium.

Traditionally, printers have been provided with a ribbon supply reel and a ribbon take-up reel. An inked ribbon is unwound from a supply reel and is wound upon a take-up reel. The supply and take-up reels are positioned so that the ribbon extends across the print region, and a drive mechanism is employed to rotate either the take-up reel or both the supply and take-up reels during printing so as to continuously move fresh ribbon in front of the printing members.

Mechanisms have also been provided to reverse the direction of rotation of the supply and take-up reels such that when the ribbon is substantially and completely unwound from the supply reel and substantially completely wound about the take-up reel, the mechanism reverses the direction of rotation of the reels, thereby reversing the functions of the supply and take-up reels.

Efforts to simplify the operating mechanism required and also to simplify the replacement of an exhausted ribbon with a fresh ribbon have led to the development of ribbon cartridges. One such cartridge is comprised of a housing containing both the supply and take-up reels. The housing is inserted upon the printer, and the ribbon portion extending between the supply and take-up reels is threaded through a ribbon guiding mechanism so as to pass in front of the print member. Although cartridges of this type simplify removal and replacement operations, mechanisms are still nevertheless required to reverse direction of movement of the reels.

The shortcomings of the last-described cartridges have led to the development of cartridges employing a Mobius Loop ribbon which is a closed continuous loop of inked ribbon folded over on itself for the purpose of providing for more complete usage of the ribbon surface without the need for a reversing operation, thereby eliminating the need for a mechanism which reverses rotation of the ribbon reels. Efforts to eliminate the need for spools in ribbon-cartridge devices have led to the development of the stuffing box cartridge which employs a Mobius Loop ribbon which passes through an outlet slot in the cartridge, extends about the ribbon guide means so as to pass in front of the print member or members, and returns to the ribbon cartridge housing through an inlet opening provided in the ribbon cartridge housing in order to be stuffed into the housing interior, typically in a random pattern.

Although ribbon cartridges of the stuffing-box type are extremely useful, it has nevertheless been found that their ribbon capacities are limited, and by arranging ribbon within the cartridge housing in a full fanfold manner, it is possible to significantly increase the amount of ribbon which may be stored therein. However, prior to the advent of the present invention, no satisfactory replacement package was available for simply and readily inserting replacement ribbons of increased ribbon length into ribbon cartridge housing to obtain reliable, trouble-free operation.

The present-day replacement ribbon is comprised of a Mobius Loop ribbon wound into a spiral coil, with the twisted-over portion being arranged at the outermost loop of the coil.

The ribbon cartridge housing which receives the ribbon is rectangular in shape and has a removable cover. The cover is lifted, and the coiled ribbon is placed within the cartridge housing. The free end of the coiled ribbon is removed from the housing and placed about the ribbon guide means and through the ribbon inlet and outlet slots provided in the ribbon cartridge housing. The ribbon is then stuffed into the housing in fanfold fashion by roller means. Folds of the inked ribbon stuffed into the cartridge housing press against the portion of the ribbon being uncoiled are sandwiched between the uncoiled ribbon portion and the housing sidewalls causing one or more of the ribbon fanfolds to be fed out of the outlet slot which is undesirable, since it causes uneven feedings and further serves to cause a creasing and tearing of the ribbon.

The diameter of the coiled ribbon of a length equal to the ribbon capacity of the ribbon cartridge housing is greater than the inner diameter of the ribbon cartridge housing. In order to insert the coiled ribbon into the ribbon cartridge housing, the coiled ribbon must be squeezed together to fit into the housing. Upon release of the ribbon, the ribbon coil expands and is urged against opposite sidewalls of the housing, creating a friction or drag which works against the smooth feeding of the ribbon causing the ribbon to feed in a very nonuniform manner and, in some cases, causing the ribbon to jam. Also, the installation operation requires the operator to handle the portion of the ribbon to be inserted into the housing which is a messy job. To date, the only effective technique to remedy this problem is to reduce the overall length of the ribbon, thereby reducing the diameter of the coiled ribbon. This solution, however, requires the use of a ribbon of less capacity than can otherwise be accommodated within the ribbon cartridge housing necessitating more frequent ribbon replacement operations. Also, due to the nonuniform feeding of the ribbon, the ribbon often develops creases or sharp folds which may catch upon the printing elements which serve to prevent the ribbon from advancing, and in the event that ribbon advancement is halted, the printing elements may repeatedly impact against the same portion of the ribbon, causing the ribbon to tear and thereby requiring premature replacement of an otherwise usable ribbon.

BRIEF DESCRIPTION OF THE INVENTION

The present invention is characterized by providing a novel ribbon replacement package which overcomes all of the disadvantages of the replacement ribbon pack which are presently in use through the employment of a Mobius Loop ribbon arranged within the package in full fanfold fashion to facilitate insertion and feeding of the ribbon within a ribbon cartridge housing, while at the same time providing a significant increase in the length of ribbon which may be so inserted into the ribbon cartridge housing without jamming.

The package of the present invention is comprised of a semirigid channel-shaped member preferably formed of a thin lightweight plastic. A semirigid plastic sheet, serving as a stripper member, is positioned within the channel-shaped member, and the fanfolds of the Mobius Loop ribbon are placed within the channel-shaped member and upon the stripper member. The free loop of ing a finger through the opening in the channel-shaped member, the channel-shaped member may then be lifted while holding the stripper plate down to prevent lifting of the fanfolds from the ribbon cartridge housing. The stripper plate is then simply lifted upwardly from its position resting upon the top of the fanfold portion of the ribbon. The free loop of ribbon extending around the exterior of the channel-shaped member is threaded through the ribbon guide means of the printer, and the cover of the ribbon cartridge housing is closed, completing the installation operation.

By arranging the ribbon in full fanfold fashion, the amount of ribbon provided in the package can be doubled over that which may be utilized in the coiled ribbon package previously mentioned hereinabove and is also a significant increase over the amount of ribbon capable of being stored in a random fold ribbon cartridge housing of the stuffing-box type. The full fanfold arrangement also substantially eliminates the possibility of improper feeding and/or creasing of the ribbon during operation of the printer.

The replacement ribbon package may be housed within a box such as, for example, a paper, plastic, or cardboard box, or may alternatively be housed within a tray-shaped member of lightweight plastic having a limp thin-gauge plastic sheet serving as a cover, which sheet is preferably fused to the upper lip of the tray. As an alternative, the ribbon installation instructions may be printed directly upon the cover sheet of the tray-shaped enclosure.

OBJECTS OF THE INVENTION AND BRIEF DESCRIPTION OF THE FIGURES

One object of the present invention is to provide a ribbon replacement package adapted to be placed into a ribbon cartridge housing during installation of a fresh ribbon to greatly simplify the installation operation.

Another object of the present invention is to provide a novel replacement ribbon package comprised of housing means for protecting a ribbon stored therein in full fanfold fashion, and which is designed with a stripper plate to facilitate stripping of the package from the ribbon after installation of the package into a ribbon cartridge housing.

Still another object of the present invention is to provide a novel replacement ribbon package for use in package is inserted therein.

FIGS. *3a*, *3b*, and *3c* are top, side, and end views, respectively, of the channel-shaped member and stripper plate employed in the replacement ribbon package of FIG. 1.

FIG. *3b* is a view of the channel-shaped member and stripper plate looking in the direction of arrows *3b*—*3b* of FIG. *3a*. FIG. *3c* is a view of the channel-shaped member and stripper plate looking in the direction of arrows *3c*—*3c* of FIG. *3b*.

FIGS. *4a*, *4b*, and *4c* are side elevation, end elevation and top plan views, respectively, of the assembled package of FIG. 1.

FIG. *4d* shows a perspective view of one alternative embodiment of the present invention.

DETAILED DESCRIPTION OF THE INVENTION AND THE PREFERRED EMBODIMENTS THEREOF

Figure 1:
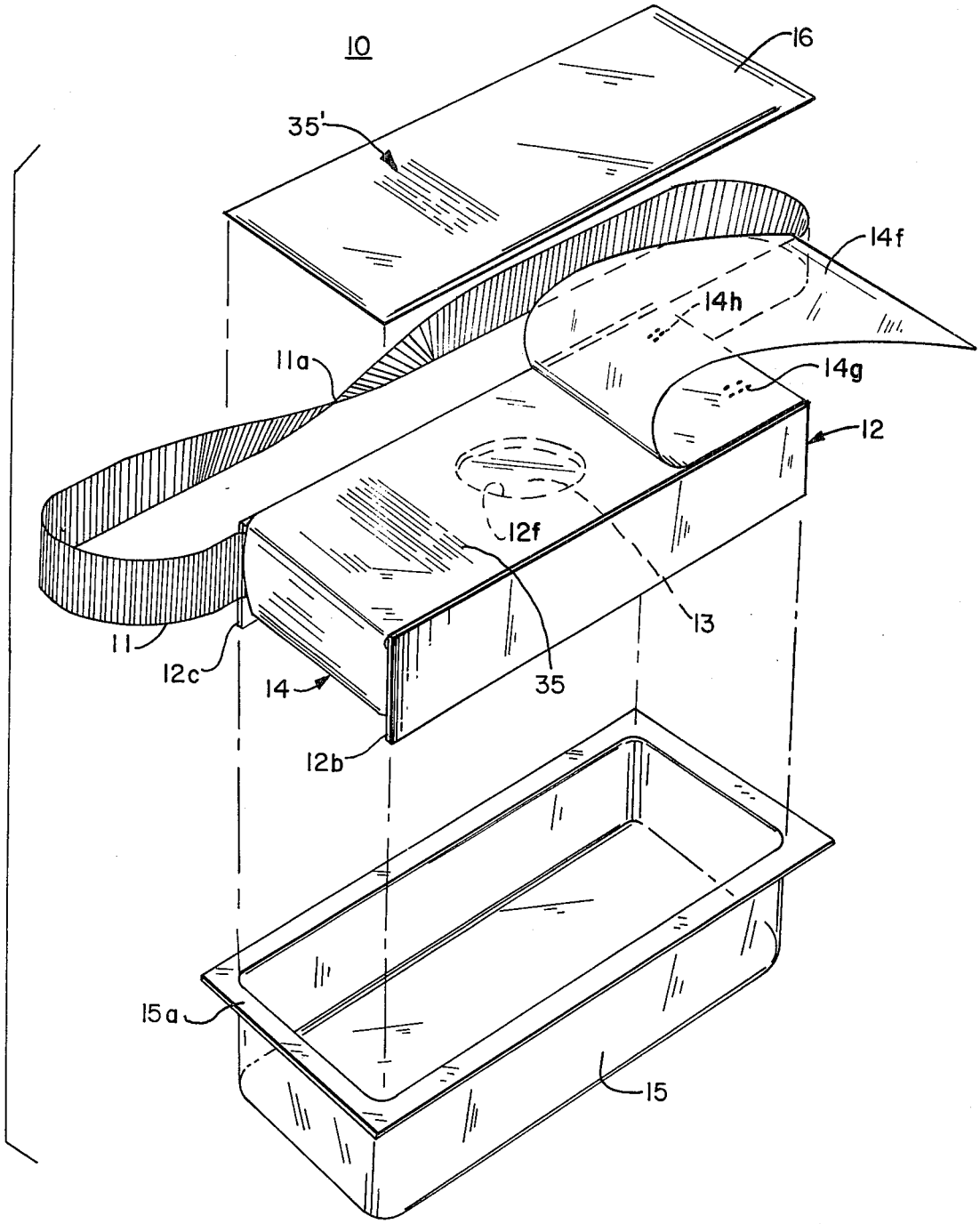

FIG. 1 shows a replacement ribbon package 10 comprised of a ribbon 11, a channel-shaped member 12, and a stripper plate 13. A tearaway wrapper 14 serves to loosely hold the fanfold portions of the ribbon 11 (to be more fully described) within the package 10 without creasing or otherwise damaging the ribbon 11. The above-mentioned elements are housed within tray 15, whose open end is covered with a thin cover sheet 16, preferably heat sealed to the upper flange 15*a* of tray 15.

As shown best in FIGS. *3a* through *3c*, channel-shaped member 12 is comprised of a base portion 12*a*, and two downwardly-depending arms or flaps 12*b* and 12*c* which join the base portion 12*a* at the bends 12*e* and 12*d*, respectively. The base portion 12*a* of channel-shaped member 12 is provided with a central opening 12*f*.

As can best be seen from FIG. *3a*, the base portion 12*a* of channel-shaped member 12 is rectangular in shape. Stripper plate 13 is also rectangular in shape and rests upon the interior surface of base portion 12*a* in the manner shown best in FIGS. *3b* and *3c*. The length of stripper plate 13 is substantially equal to the length of base portion 12*a*, while the width of stripper plate 13 is slightly less than the width of base portion 12*a* to permit the stripper plate 13 to be positioned to rest against the interior surface of base portion 12*a* in the manner shown best in FIGS. *3b* and *3c*.

The channel-shaped member 12 and stripper plate 13 are preferably formed of relatively thin-gauge, lightweight and yet sturdy plastic material so as to be semi-rigid in order to provide an enclosure of sufficient strength to protect the ribbon 11 from being creased or damaged during storage. In one preferred embodiment, the stripper plate 13 and channel-shaped member 12 are formed of styrene having a thickness in the range of 0.015 to 0.025 inches and preferably 0.020 inches. Obviously, any other materials exhibiting the characteristics of styrene may be employed with equal success.

The ribbon 11 is an elongated Mobius Loop ribbon, wherein one end of the ribbon 11 is twisted and joined to an opposite end, the twist, for example, being shown at position 11*a* in FIG. 1. In one preferred embodiment, the total length of the ribbon 11 is 20 yards. The ribbon 11 is arranged within the channel-shaped member 12 and is supported by stripper plate 13, as shown best in FIGS. 4*a* through 4*c*. The ribbon 11 is arranged in full fanfold fashion in such a manner that alternate loose folds or loops preferably extend substantially to the interior surface of each of the flanges or flaps 12*c* and 12*b*. For example, loose fold 11*b* lies adjacent the interior surface of flap 12*c*, loose fold 11*c* lies adjacent to flap 12*b*, loose fold 11*d* lies adjacent to flap 12*c*, loose fold 11*e* lies adjacent to flap 12*b*, and so forth. The full fanfold arrangement extends from one end of the channel-shaped member 12 to the other, and preferably all loops are arranged in close proximity to an associated one of the flaps 12*b* and 12*c*.

Figure 4A:
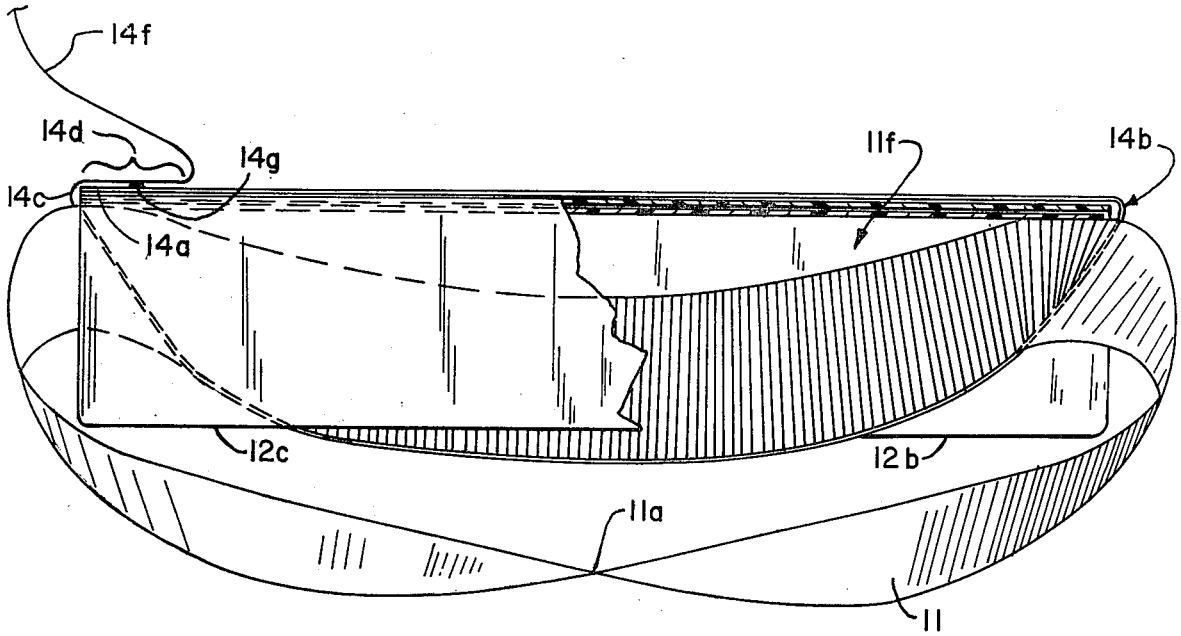
Figure 4B:
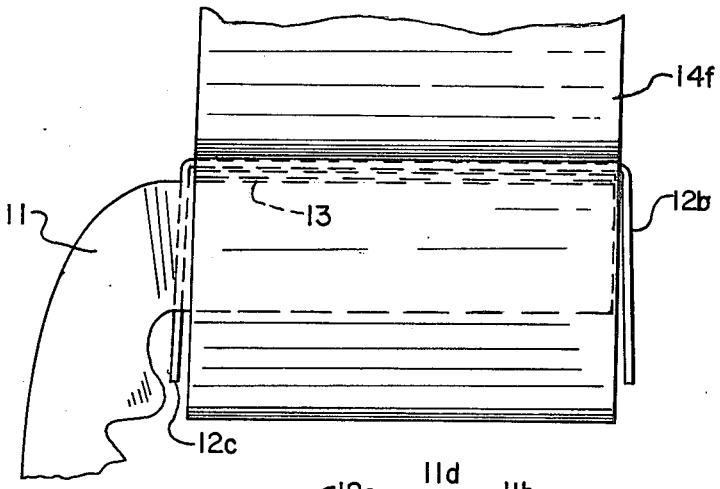
Figure 4C:
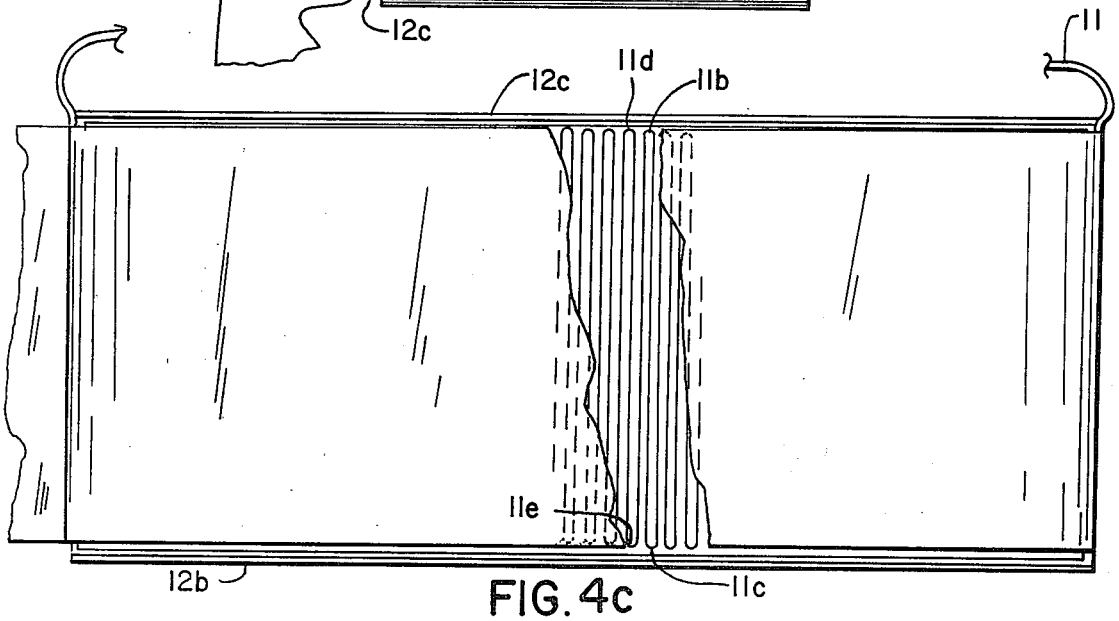

A portion of the continuous Mobius Loop ribbon 11 extends beyond the opposite ends of the channel-shaped member 12 and more specifically beyond the opposite ends of flap 12*c*, so that a length of ribbon 11 including the twisted portion 11*a* lies outside of the package 10 in the manner shown best in FIGS. 1 and 4*a*.

The fanfold portion of the Mobius Loop ribbon 11 is retained in position within the channel-shaped member 12 by means of tearaway strip 14, which is comprised of an elongated substantially rectangular-shaped sheet, preferably formed of a thin-gauge plastic material. In one preferred embodiment, the strip 14 is formed of polyethylene having a thickness in the range from 0.002 to 0.004 inches and preferably of 0.003 inch thickness. A first end of this strip 14, starting with edge 14*a*, is laid upon the outer surface of base portion 12*a*, as shown best in FIG. 4*a*. The strip 14 extends over the length of the base portion 12*a* and is curved about the right-hand end of base portion 12*a*, as shown in 14*b*, and extends between base portion 12*a* so as to embrace the fanfold portion 11*f* of the Mobius Loop ribbon 11. The tearaway strip 14 extends beneath the entire fanfold portion 11*f* and is bent around and over the left-half end of base portion 12*a*, as shown at 14*c*, so that a portion 14*d* of the tearaway strip rests upon the left-hand end 14*a* of the tearaway strip 14 previously placed upon the exterior surface of channel-shaped member base portion 12*a*. The tearaway strip 14 is secured in the region where it overlaps upon itself, preferably by a heat-sealing operation. The shaded regions 14*g*, 14*h* of FIG. 1 represent the locations where the tearaway strip 14 has been fused to itself, preferably by a spot heat-sealing operation. The free end 14*f* of the tearaway strip 14 is of a length sufficient to serve as a pull tab for facilitating gripping by an operator to quickly and easily remove the strip 14 from the package 10 after it has been installed within a ribbon cartridge assembly, as will be more fully described.

Figure 2:
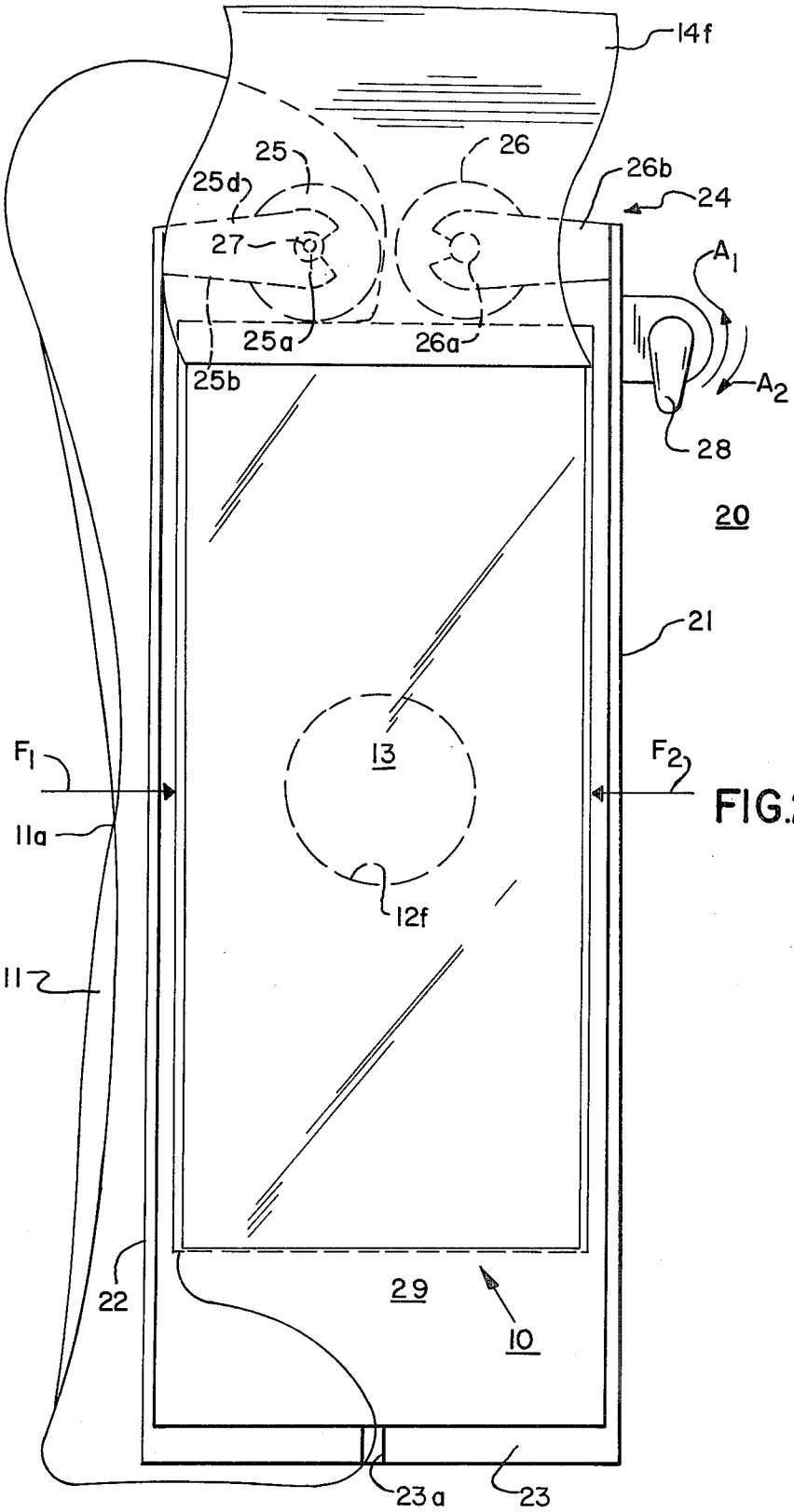
Figure 3A:
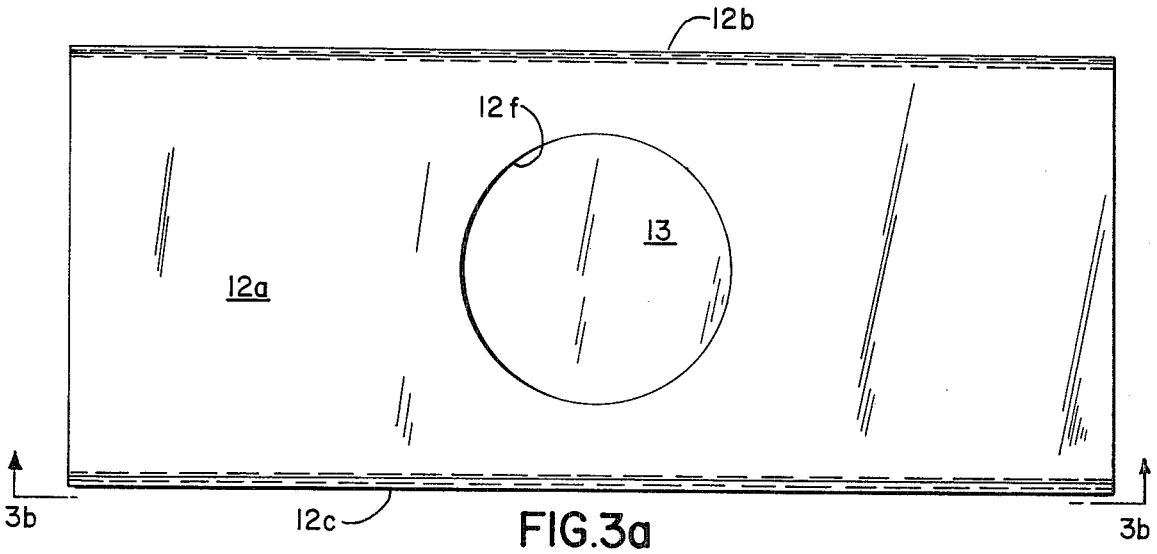
Figure 3B:
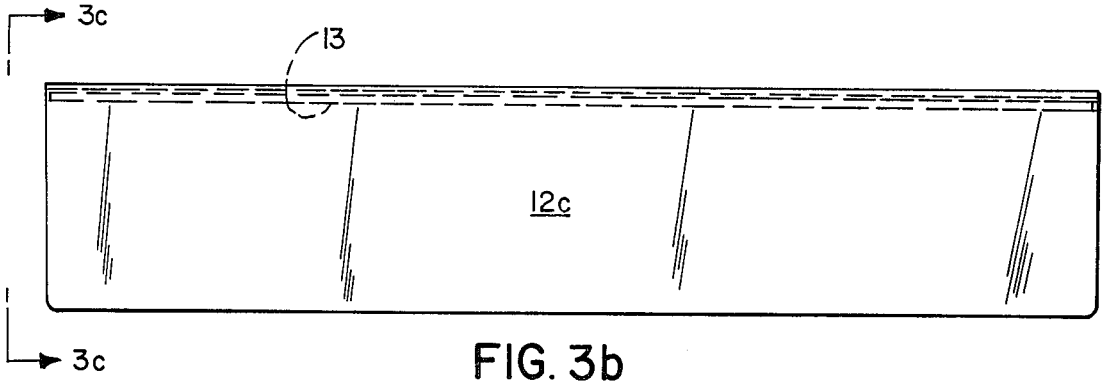
Figure 3C:
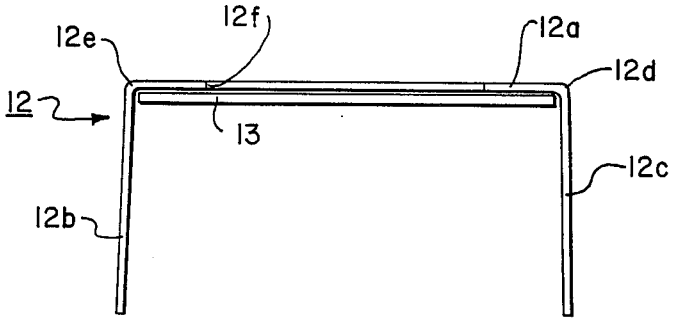

FIG. 2 shows a ribbon cartridge assembly 20 comprised of sidewalls 21 and 22, rear end wall 23 and a front end wall 24 provided with a pair of rollers 25 and 26 cooperatively adapted to stuff the ribbon 11 into the ribbon cartridge assembly 20, as will be more fully described.

Rear end wall 23 is provided with a slot 23*a* for allowing the ribbon 11 to be moved out of the ribbon cartridge assembly 20, while ribbon 11 enters into the forward end of the ribbon cartridge assembly 20 by passing between rollers 25 and 26. Although not shown for purposes of simplicity, it should be understood that the ribbon cartridge assembly 20 is provided with a cover lid for fully enclosing the ribbon 11 within the ribbon cartridge assembly 20, said cover lid having a configuration substantially conforming to the configuration of the ribbon cartridge assembly 20 shown in FIG. 2. A more detailed description of the ribbon cartridge assembly 20 is set forth in the Technical Manual entitled "Model 700 Printer", copyright June, 1977 by Centronics Data Computer Corp., detailed information relating to the ribbon cartridge assembly 20 being set forth at pages 3-2, 3-3, and 3-10. Further details of the ribbon cartridge assembly 20 will therefore be omitted herein as being beyond the scope of the present invention.

The roller 25, as described in the above-mentioned Technical Manual, is driven by a drive shaft 27 which extends through the center of the shaft 25*a*, upon which roller 25 is mounted. Shaft 25*a* is rotatably supported by arm 25*b*. Roller 26 is free-wheelingly mounted upon shaft 26*a* which is supported within a support arm 26*b* and which is adapted to be resiliently urged toward the left so as to establish firm rolling engagement with roller 25. This is accomplished by moving swingably-mounted lever arm 28 to the solid line position shown in FIG. 2 in order to operate upon a resilient member (not shown) described in the aforementioned Technical Manual. By rotating lever arm 28 in a counterclockwise direction, as shown by arrow A1, the roller 26 is moved into rolling engagement with roller 25. By moving lever 28 in a clockwise direction, as shown by arrow A2, back to the position shown in FIG. 2, the roller 26 is moved out of rolling engagement with roller 25, as shown in FIG. 2 to facilitate insertion and/or removal of a ribbon 11.

Installation of a fresh ribbon 11 is performed in the following manner:

The lid (not shown) of the ribbon cartridge assembly 20 is removed from the assembly 20 to expose the depleted ribbon 11 (not shown). Lever 28 is moved to the position shown in FIG. 2 in order to separate rollers 25 and 26. The depleted ribbon 11 contained within the ribbon cartridge assembly 20 is removed by lifting the depleted ribbon 11 out of the assembly 20 and out of the slot 23*a* and out from between rollers 25 and 26. Although not shown, it should further be understood that the loop of ribbon 11 extending outside of the assembly 20 should be lifted away from the guide members (not shown) which guide the ribbon 11, so as to pass in front of the print member. This is shown, for example, on pages 3-2 and 3-6 of the aforementioned Centronics' Technical Manual.

Once the depleted ribbon 11 has been removed from the ribbon cartridge assembly 20, the thin cover sheet 16 is peeled away from tray 15, and the entire ribbon replacement package 10, comprised of channel-shaped member 12, stripper plate 13, ribbon 11, and tearaway FIG. 2. The remaining portion of the loop is arranged about the ribbon guide members (not shown for purposes of simplicity) so as to properly position the ribbon 11, especially with respect to the printing position which is shown, for example, in detail in the aforementioned Centronics' Model 700 Printer Technical Manual.

With the ribbon package 10 positioned in the manner described, the free portion 14*f* of the tearaway strip 14 forms a tab which is grasped by the operator and pulled upwardly, so as to release the fused portions 14*g* and 14*h* of the strip 14. The edges of the channel-shaped member 12 may then be gripped by the fingers in the positions shown by arrows F1 and F2, so as to hold the channel-shaped member 12 within the ribbon cartridge assembly 20 while pulling tab 14*f* upwardly and away from the ribbon cartridge assembly 20. Once the strip 14 is completely removed from the package 10 and the ribbon cartridge assembly 20, the operator places a finger (or any other suitable instrument) through the opening 12*f* in channel-shaped member 12 so that the finger rests upon the upper exposed surface of stripper plate 13. With the fingers positioned at the locations of arrows F1 and F2, or any other suitable locations, the channel-shaped member 12 is lifted upwardly and out of the ribbon cartridge assembly 20 at the same time that the ribbon 11 is held in position within the ribbon cartridge assembly 20 by applying a light pressure to the stripper plate 13 to allow the channel-shaped member 12 to be lifted outwardly and away from the ribbon 11 and the ribbon cartridge assembly 20 without having the fanfold portion 11*f* of the ribbon 11 lifted upwardly with the channel-shaped member 12 due to any frictional engagement between one or more of the fanfold 11*b*—11*e* and the adjacent interior surfaces of flaps 12*b* and 12*c*.

Once the channel-shaped member 12 has been removed from the ribbon 11 and the cartridge assembly 20, the stripper plate 13 need simply be lifted away from the top of the ribbon fanfold portion 11*f* and the cover of the ribbon cartridge assembly 20 may be replaced, thereby completing the installation operation.

As was described hereinabove, the replacement ribbon package is stored within a tray 15, which is preferably vacuum formed from a suitable plastic material and being of a relatively thin gauge, although thick enough to have inherent structural strength to protect the ribbon 11 housed therein against crushing. For example, the tray 15 has more than sufficient structural strength to permit stacking of trays 15 one upon the other without causing a collapse or crushing of any of the bottommost trays 15 in such a stack.

Figure 4D:
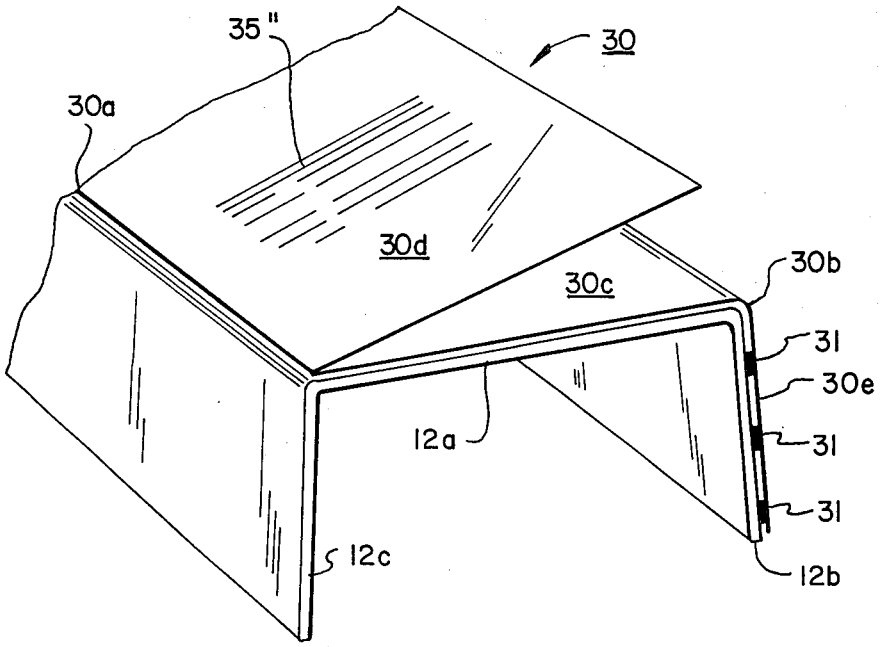

As another alternative arrangement, the ribbon replacement package 10 may be housed within a paper or cardboard carton or a bag with the instructions provided thereon. For example, the plastic bag may be provided with a header having instructions printed thereon. As a further alternative embodiment, the instructions may be printed on a separate sheet 30, as shown in FIG. 4*d*, which sheet 30 may be either stiff paper or light cardboard which is bent to form folds 30*a* and 30*b*, thereby dividing the sheet 30 into a center portion 30*c*, an upper flap 30*d*, and a lower flap 30*e*. The folded sheet 30 is arranged so that central portion 30*c* rests upon the exterior surface of base portion 12*a* and so that downwardly depending flap 30*e* rests against flap 12*b* of the channel-shaped member 12. The flap 30*e* may be adhered to flap 12*b* by means of a suitable adhesive, which may be applied, for example, as a plurality of longitudinal stripes, the ends of said stripes 31 being visible in FIG. 4*d*. The instructions may be placed upon the exterior surface of flap 30*d*, as shown at 35", or upon the interior surface thereof. Base portion 30*c* of the folded sheet 30 may be lifted to facilitate gripping and removal of tearaway strip 14 and to gain access to opening 12*f* in base portion 12*a* to permit the stripper plate 13 to be held in place while the channel-shaped member 12 is lifted out of the ribbon cartridge assembly 20, as was set forth hereinabove in the description of the ribbon installation operation. When using the embodiment of FIG. 4*d*, the instruction sheet 30 is so arranged that it need not be removed from the replacement ribbon package 10 during installation of the package 10 into ribbon cartridge assembly 20. However, the instruction sheet 30 may be removed from the package 10 by the operator prior to insertion into cartridge assembly 20, depending only upon the preferences of the operator.

The folded flap 30*d* preferably rests upon the tear strip 14 when it is in position in the housing, i.e., tray 15.

Since the tear strip 14 is preferably formed of a limp transparent plastic, the instructions 35 may be printed upon the exterior surface of flap 30*d* and be viewed directly through the tear strip 14.

As can best be seen in FIG. 4*a*, the tearaway strip 14 encircles the package 10 and is arranged to loosely hold the fanfold portion 11*f* of the ribbon 11 to prevent any portions of the ribbon 11 contained in channel-shaped member 12 from being pressed together to the point where a permanent crease may form therein. Thus, when properly assembled, if the replacement ribbon package 10 is held in the manner shown in FIG. 4*a*, the ribbon 11 can be seen to droop slightly indicating that the tearaway strip 14 is mounted properly. However, it should be understood that the package 10, as shown in FIG. 4*a*, is normally retained within the tray housing 15 said substantially rigid package member in said cartridge housing;

lifting said substantially rigid package member upwardly and away from said ribbon and out of said cartridge housing, while holding down said stripper plate to facilitate removal of the first substantially rigid package member and thereby prevent the ribbon from being lifted from said cartridge housing; and lifting said stripper plate from said ribbon.

* * * * *

United States Patent [19]

Acosta

[11] 4,240,758

[45] Dec. 23, 1980

[54] METHOD AND APPARATUS FOR ESTABLISHING TAB SETTINGS AND INDEXING PARAMETERS, AND PRINTOUTS REPRESENTING SAME, FOR A WORD PROCESSING SYSTEM

[75] Inventor: Robert G. Acosta, Austin, Tex.

[73] Assignee: International Business Machines Corporation, Armonk, N.Y.

[21] Appl. No.: 884,055

[22] Filed: Mar. 6, 1978

[51] Int. Cl.[3] ..... B41J 5/30

[52] U.S. Cl. ..... 400/279; 400/63; 400/70; 400/76; 364/900

[58] Field of Search ..... 400/61, 62, 63, 64, 400/74, 76, 279, 280, 281, 282, 697, 70; 364/900

[56] References Cited

U.S. PATENT DOCUMENTS

| | | | |
|---|---|---|---|
| 2,762,485 | 9/1956 | Bafour et al. | 400/76 X |
| 2,947,357 | 8/1960 | Bafour et al. | 400/70 X |
| 3,015,377 | 1/1962 | Reitfort | 400/70 X |
| 3,045,218 | 7/1962 | Brand | 400/697 X |
| 3,611,308 | 10/1971 | Grinnell | 400/280 X |
| 3,675,216 | 7/1972 | James | 364/900 |
| 3,940,746 | 2/1976 | Vittorelli | 400/63 X |
| 3,952,852 | 4/1976 | Greek et al. | 400/76 X |
| 4,004,675 | 1/1977 | Ludwig | 400/281 |
| 4,031,996 | 6/1977 | Busch | 400/279 |
| 4,067,430 | 1/1978 | Wienhold | 400/279 X |

FOREIGN PATENT DOCUMENTS

| | | | |
|---|---|---|---|
| 1176441 | 1/1970 | United Kingdom | 400/279 |
| 1443050 | 7/1976 | United Kingdom | 400/279 |

OTHER PUBLICATIONS

IBM Technical Disclosure Bulletin, "Format Storage and Retrieval for Automatic Typewriter", Johnson, vol. 13, No. 8 Jan. 1971, pp. 2141–2142.

IBM Technical Disclosure Bulletin, "Alternate Tab Controls for Typewriter", McCray, vol. 18, No. 5 Oct. 1975, pp. 1511, 1512.

IBM Technical Disclosure Bulletin, "Tab Expansion in Line Memory of Typewriter", McCray, vol. 18, No. 5 Oct. 1975, pp. 1513, 1514.

IBM Technical Disclosure Bulletin, "Tab Stop Storage", McCray, vol. 18, No. 10 Mar. 1976, p. 3353.

IBM Technical Disclosure Bulletin, "Input Storage and Output Setting of Tabs", Tanner, vol. 15, No. 9 Feb. 1973, p. 2769.

IBM Technical Disclosure Bulletin, "Method of Tab Storage", Bowles et al., vol. 17, No. 1 Jun. 1974, pp. 131–132.

*Primary Examiner*—Ernest T. Wright, Jr.

*Attorney, Agent, or Firm*—John W. Henderson, Jr.

[57] ABSTRACT

Disclosed is a method and apparatus for establishing, verifying, and correcting tab settings and indexing parameters for text to be printed by a word processing system. The apparatus includes logic and related control networks for establishing a line of codes in memory indicative of the location and status of such tab settings and indexing parameters, for setting an electronic tab rack, for verifying and correcting such settings and parameters by, and responsive to, the advancement and backspacing of the printer carrier, and for producing a hard copy printout, during entry and playback, of such tab setting and indexing mode status.

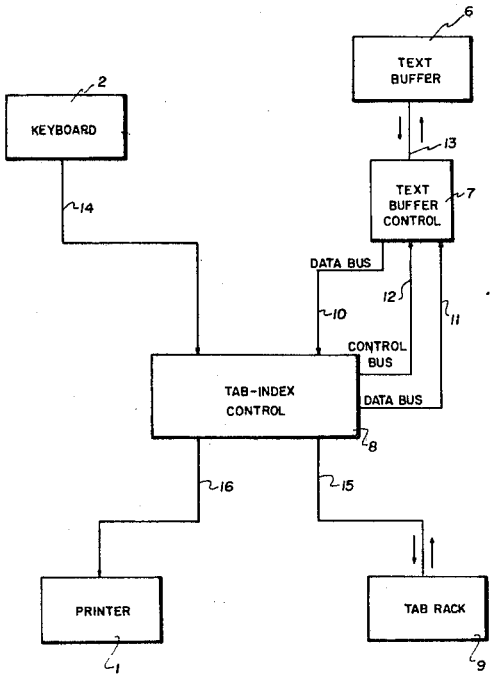

7 Claims, 48 Drawing Figures